US009921530B2

(12) United States Patent
Gon

(10) Patent No.: US 9,921,530 B2
(45) Date of Patent: Mar. 20, 2018

(54) FIXING DEVICE AND IMAGE FORMING APPARATUS

(71) Applicant: KYOCERA Document Solutions Inc., Osaka-shi, Osaka (JP)

(72) Inventor: Shoko Gon, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/460,014

(22) Filed: Mar. 15, 2017

(65) Prior Publication Data

US 2017/0299990 A1 Oct. 19, 2017

(30) Foreign Application Priority Data

Apr. 18, 2016 (JP) ..... 2016-082936

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01)

(58) Field of Classification Search
CPC . G03G 15/2039; G03G 15/2078; G03G 15/80
See application file for complete search history.

(56) References Cited

U.S. PATENT DOCUMENTS 8,934,791 B2 * 1/2015 Eiki ..... G03G 15/2039 399/33

FOREIGN PATENT DOCUMENTS

JP 2014124814 A 7/2014

* cited by examiner

*Primary Examiner* — Sophia S Chen
(74) *Attorney, Agent, or Firm* — Alleman Hall Creasman & Tuttle LLP

(57) ABSTRACT

A frequency determining portion determines a driving frequency of an induction heater. A determination processing portion determines whether or not the driving frequency determined by the frequency determining portion is within a predetermined prohibited frequency band. A frequency changing portion, when the driving frequency determined by the frequency determining portion is within the prohibited frequency band and is lower than a predetermined threshold within the prohibited frequency band, changes the driving frequency to a frequency equal to or lower than a lower boundary frequency of the prohibited frequency band, and when the driving frequency is within the prohibited frequency band and is equal to or higher than the threshold, changes the driving frequency to a frequency equal to or higher than a higher boundary frequency of the prohibited frequency band. A heating control portion drives the induction heater by the driving frequency changed by the frequency changing portion.

7 Claims, 8 Drawing Sheets

FIXING DEVICE AND IMAGE FORMING APPARATUS

INCORPORATION BY REFERENCE

This application is based upon and claims the benefit of priority from the corresponding Japanese Patent Application No. 2016-082936 filed on Apr. 18, 2016, the entire contents of which are incorporated herein by reference.

BACKGROUND

The present disclosure relates to an induction heating type fixing device, and to an image forming apparatus.

An operation frequency, a switching frequency or the like of a power source circuit provided in an image forming apparatus may affect and cause another electronic device, such as a security gate device, to malfunction.

There is known an image forming apparatus which, to prevent such a malfunction, switches a driving frequency of the power source circuit of the image forming apparatus from a normal frequency to a predetermined malfunction prevention frequency.

SUMMARY

A fixing device according to an aspect of the present disclosure includes a heated member, an induction heater, a frequency determining portion, a frequency changing portion, and a heating control portion. The induction heater heats the heated member by induction heating. The frequency determining portion determines a driving frequency of the induction heater. The determination processing portion determines whether or not the driving frequency determined by the frequency determining portion is within a predetermined prohibited frequency band. The frequency changing portion, when the driving frequency determined by the frequency determining portion is within the prohibited frequency band and is lower than a predetermined threshold within the prohibited frequency band, changes the driving frequency to a frequency equal to or lower than a lower boundary frequency of the prohibited frequency band, and when the driving frequency is within the prohibited frequency band and is equal to or higher than the threshold, changes the driving frequency to a frequency equal to or higher than a higher boundary frequency of the prohibited frequency band. The heating control portion drives the induction heater by the driving frequency changed by the frequency changing portion.

An image forming apparatus according to another aspect of the present disclosure includes an image generating portion and the fixing device. The image generating portion forms a toner image on a sheet. The fixing device fixes the toner image to the sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Outline Configuration of Image Forming Apparatus]

Figure 1:
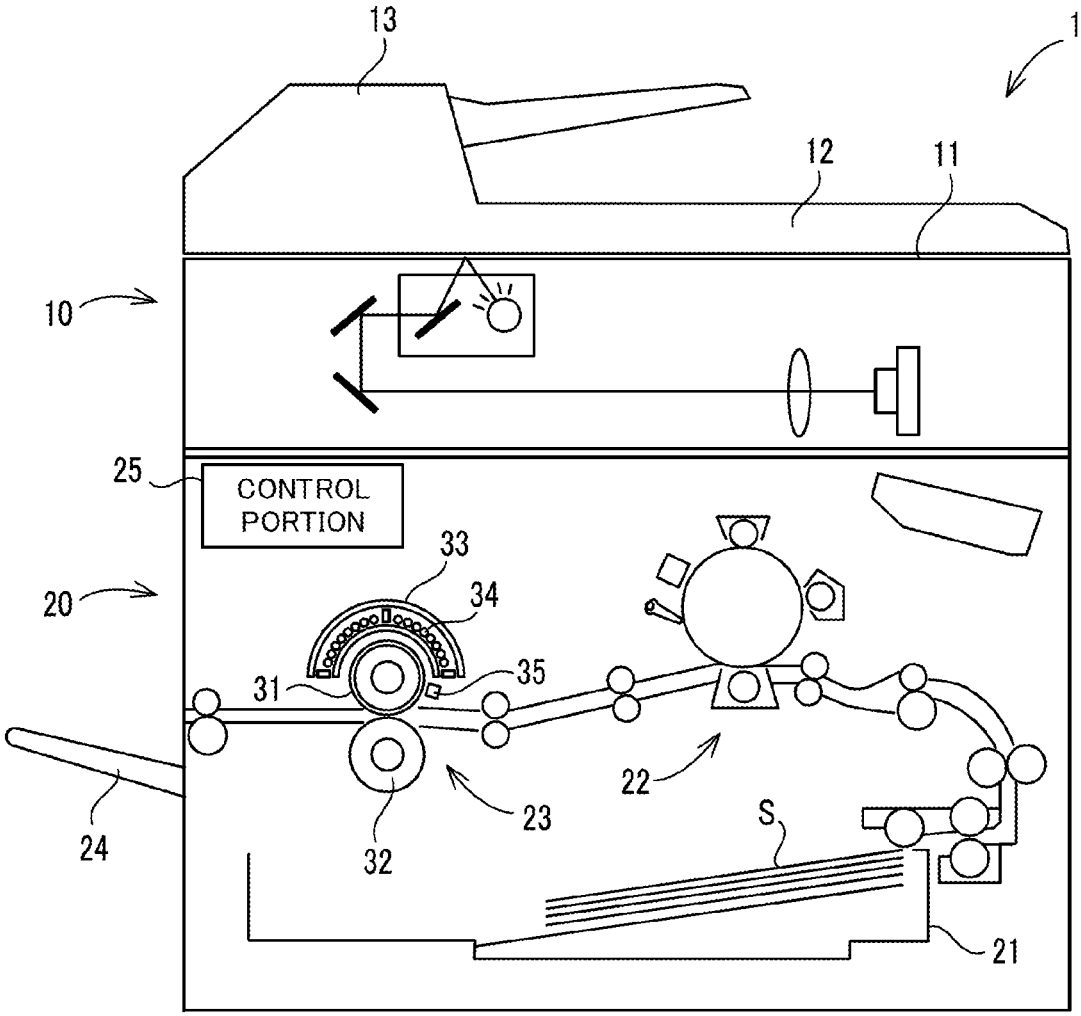
FIG. 1 is a diagram showing a configuration of an image forming apparatus according to an embodiment of the present disclosure.

First, a description is given of an outline configuration of an image forming apparatus 1 according to an embodiment of the present disclosure, with reference to FIG. 1.

The image forming apparatus 1 shown in FIG. 1 includes functions of a printer, a copier, a facsimile and the like. The image forming apparatus 1 prints an image on a sheet S based on input image data. The image forming apparatus 1 includes an image reading portion 10 and an image forming portion 20, wherein the image reading portion 10 is configured to read an image from a document sheet, and the image forming portion 20 is an electrophotographic image forming portion. It is noted that although the image forming apparatus 1 is described in the present embodiment as an example of the image forming apparatus according to the present disclosure, the present disclosure is not limited to this, but is applicable to a printer, a facsimile device, and a copier as well, for example.

Figure 2:
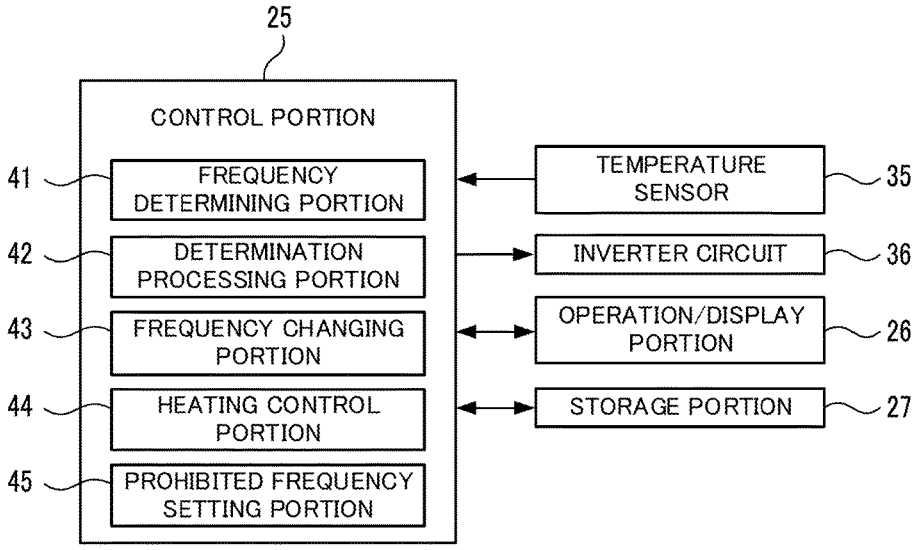
FIG. 2 is a block diagram showing a system configuration of the image forming apparatus according to the embodiment of the present disclosure.

The image reading portion 10 includes a contact glass 11 and a document sheet cover 12, wherein the contact glass 11 constitutes a document sheet mounting surface, and the document sheet cover 12 is opened and closed with respect to the contact glass 11. When the image forming apparatus 1 functions as a copier, a document sheet is set on the contact glass 11, and the document sheet cover 12 is closed. Thereafter, when a copy start instruction is input from an operation/display portion 26 (see FIG. 2), the image reading portion 10 starts performing reading operation to read image data from the document sheet. It is noted that the document sheet cover 12 includes an ADF (Automatic Document Feeder) 13 that automatically feeds a document sheet that is a target of the reading.

The image forming portion 20 is an electrophotographic image forming portion that executes an image forming process (printing process) based on image data read by the image reading portion 10, or image data input from an external information processing apparatus. As shown in FIG. 1, the image forming portion 20 includes a sheet feed cassette 21, an image generating portion 22 (an example of the image generating portion of the present disclosure), a fixing portion 23, and a discharge portion 24. A combination of the fixing portion 23 and a control portion 25 described below is an example of the fixing device of the present disclosure.

Sheets S stored in the sheet feed cassette 21 are fed one by one by a feed mechanism that includes a feed roller. The sheet S is conveyed along a conveyance path in the image forming portion 20, passes through the image generating portion 22 and the fixing portion 23, and is discharged to the discharge portion 24.

The image generating portion 22 includes an exposure device, a photoconductor drum, a charging device, a developing device, a transfer roller, a cleaning blade, and an electricity removing device, and forms a toner image on a sheet S that passes through a nip portion between the photoconductor drum and the transfer roller.

The fixing portion 23 includes a fixing roller 31, a pressure roller 32, an induction heater 33, a temperature sensor 35, an inverter circuit 36, and a rectifier circuit 37, and fixes the toner image to the sheet S.

The fixing roller 31 includes a roller portion and a belt portion (an example of the heated member of the present disclosure). The roller portion includes, for example, a cylindrical core metal made of stainless steel or the like, and an elastic layer made of silicone resin or the like and formed on the core metal. The belt portion is a cylindrical, endless-belt-like member provided along an outer circumferential surface of the roller portion. The belt portion includes a film base member, an elastic layer, and a releasing layer, wherein the film base member is a nickel metal product processed in the shape of a cylinder, the elastic layer is made of silicone resin or the like and formed on the film base member, and the releasing layer is made of fluororesin or the like to cover the surface of the elastic layer.

The pressure roller 32 is disposed to face and pressed against the fixing roller 31. The pressure roller 32 includes, for example, a cylindrical core metal made of stainless steel or the like, an elastic layer made of silicone resin or the like and formed on the core metal, and a releasing layer made of fluororesin or the like and covering the surface of the elastic layer. The pressure roller 32 is rotated by a driving force from a drive motor (not shown). When the pressure roller 32 rotates, the driving force is transmitted from the pressure roller 32 to the fixing roller 31 via the nip portion between the pressure roller 32 and the fixing roller 31, and the fixing roller 31 is rotated as well.

The induction heater 33 is configured to heat the belt portion of the fixing roller 31 by induction heating, and includes an induction coil 34 that is disposed near the belt portion along an outer circumferential surface of the fixing roller 31. A high-frequency current is applied to the induction coil 34 by the inverter circuit 36 (see FIG. 3) that is described below. The induction coil 34 is excited by the applied high-frequency current and induction-heats the belt portion of the fixing roller 31 by a magnetic flux generated by the excitation.

When the sheet S passes through the nip portion between the pressure roller 32 and the belt portion heated by the induction heater 33, the toner image is fixed to the sheet S.

The temperature sensor 35 detects the surface temperature of the fixing roller 31. The temperature sensor 35 is, for example, a thermistor disposed in proximity to the surface of the fixing roller 31.

Figure 3:
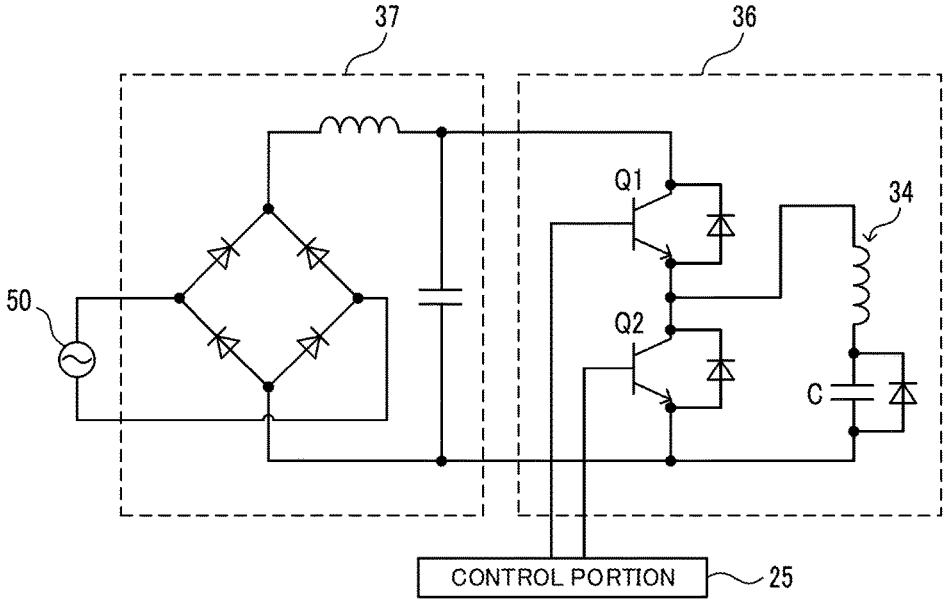
FIG. 3 is a diagram showing an example of a driving circuit of an induction heater included in the image forming apparatus according to the embodiment of the present disclosure.

As shown in FIG. 3, the inverter circuit 36 is, for example, a current resonance type inverter circuit including switching elements. The inverter circuit 36 is connected to an external commercial AC power source 50 via the rectifier circuit 37. The rectifier circuit 37 converts an AC current supplied from the commercial AC power source 50, to a DC current. The inverter circuit 36 converts the DC current supplied from the rectifier circuit 37 to a high-frequency current, and supplies the high-frequency current to the induction coil 34.

In the inverter circuit 36, the induction coil 34 and a resonance capacitor C are connected in series, the induction coil 34 and the resonance capacitor C constituting a resonance circuit. The inverter circuit 36 includes a pair of switching elements Q1 and Q2. The switching element Q2 is connected in parallel to the induction coil 34 and the resonance capacitor C.

A drive signal from the control portion 25 is input to gate terminals of the switching elements Q1 and Q2. The drive signal is a signal for switching between an ON state and an OFF state of the switching elements Q1 and Q2 at a predetermined driving frequency. As the switching elements Q1 and Q2 are switching-controlled in response to the drive signal, a high-frequency current corresponding to the driving frequency is applied to the induction coil 34.

Figure 4:
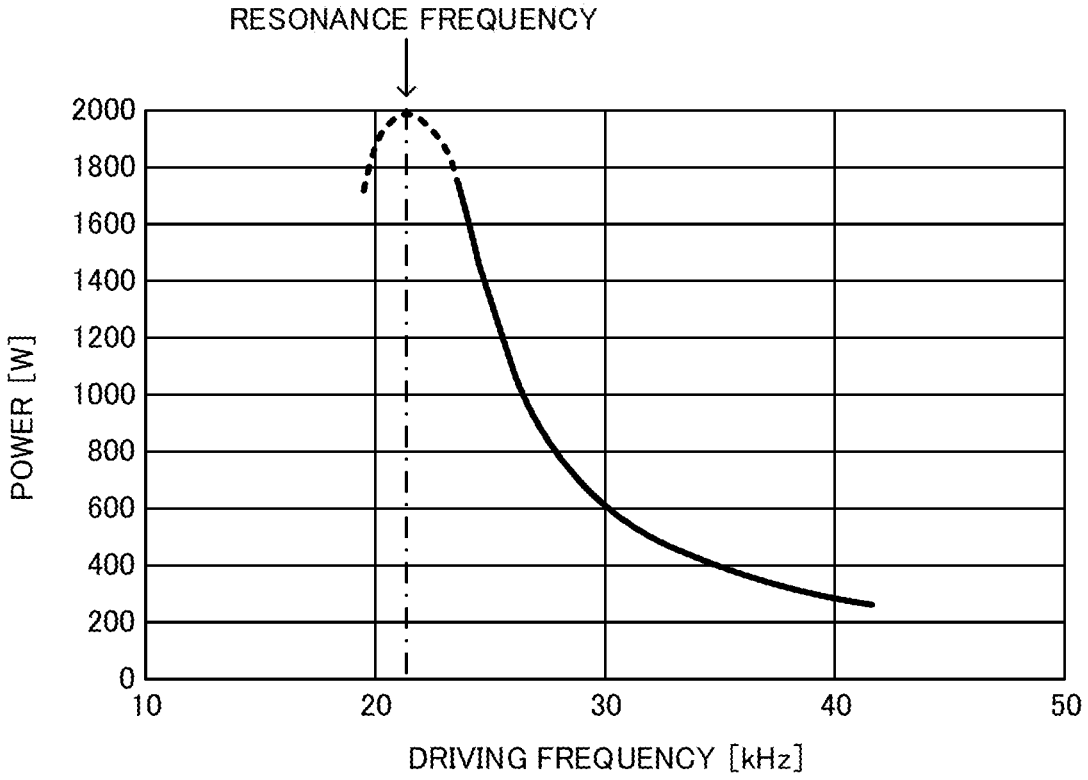
FIG. 4 is a diagram showing an example of relationship between power and a driving frequency of the induction heater included in the image forming apparatus according to the embodiment of the present disclosure.

As shown in FIG. 4, when the driving frequency changes, the power consumed by the induction coil 34 changes. When the power consumed by the induction coil 34 changes, the heating value of the belt portion of the fixing roller 31 changes. As a result, it is possible to control the heating value of the belt portion by controlling the driving frequency. The power consumed by the induction coil 34 becomes the maximum when the driving frequency is equal to a resonance frequency that is determined by the electrostatic capacitance of the resonance capacitor C and the inductance of the induction coil 34. It is noted that when the driving frequency is lower than the resonance frequency, there is a possibility that the switching elements Q1 and Q2 are broken. As a result, the driving frequency is controlled so as to be equal to or higher than the resonance frequency. Accordingly, the higher the driving frequency is, and the more away from the resonance frequency the driving frequency is, the smaller the heating value of the belt portion is. On the contrally, the lower the driving frequency is, and the closer to the resonance frequency the driving frequency is, the greater the heating value of the belt portion is.

The operation/display portion 26 includes a display portion and an operation portion, wherein the display portion is, for example, a liquid crystal display and displays information, and the operation portion includes a touch panel and operation buttons for receiving user operations.

The storage portion 27 is a nonvolatile storage portion such as EEPROM™. The storage portion 27 stores various types of data and various control programs to be executed by the control portion 25.

The control portion 25 includes control equipment such as CPU, ROM, and RAM. The CPU is a processor that executes various calculation processes. The ROM is a non-volatile storage portion in which various information such as control programs for causing the CPU to execute various processes are stored in advance. The RAM is a volatile or nonvolatile storage portion that is used as a temporary storage memory (working area) for the various processes executed by the CPU.

Specifically, the control portion 25 includes a frequency determining portion 41, a determination processing portion 42, a frequency changing portion 43, a heating control portion 44, and a prohibited frequency setting portion 45. It is noted that the control portion 25 functions as these processing portions when it executes various processes in accordance with the control programs. In addition, the control portion 25 may include an electronic circuit that realizes part or all of processing functions of the processing portions.

The frequency determining portion 41 determines a driving frequency of the induction heater 33 (namely, a driving frequency of the switching elements Q1 and Q2). Specifically, the frequency determining portion 41 determines the driving frequency such that the power supplied to the induction coil 34 matches a target power. The power supplied to the induction coil 34 is detected by a power detecting portion (not shown) at a predetermined cycle, for example. The frequency determining portion 41 performs a feedback control of the driving frequency by a PID control or the like so that the power detected by the power detecting portion matches the target power. The target power varies continually based on the output result of the temperature sensor 35 or the like. The driving frequency determined by the frequency determining portion 41 varies within a predetermined range (normally, within a range of approximately 21 to 60 kHz) in correspondence with the target power.

It is noted that in an initial phase immediately after a power-on of the inverter circuit 36, the frequency determining portion 41 executes a start-up control instead of the feedback control. In the start-up control, the driving frequency is controlled in a stepwise manner based on a fixed frequency table that is stored in the ROM, the storage portion 27 or the like in advance, and then the control transitions to the feedback control.

Meanwhile, in a case where another electronic device such as a security gate device is installed in proximity to the image forming apparatus 1, a frequency of a high-frequency current applied to the induction coil 34 may interfere with a use frequency of the other electronic device, and the other electronic device may malfunction. With regard to this problem, it would be considered that the driving frequency might be changed to a particular driving frequency that would not interfere with the use frequency of the other electronic device. However, in an image forming apparatus adopting the induction heating such as the image forming apparatus 1 of the present embodiment, the operation frequency of the induction heater 33 may need to be changed continually in correspondence with the continually varying target power. Thus it is difficult to drive the induction heater 33 by a particular driving frequency. Accordingly, in the present embodiment, as described below, a malfunction of the other electronic device is prevented by changing the driving frequency as necessary.

The determination processing portion 42 determines whether or not the driving frequency determined by the frequency determining portion 41 is within a predetermined prohibited frequency band. Specifically, the determination processing portion 42 determines that the driving frequency is within the prohibited frequency band when the driving frequency is higher than a lower boundary frequency LF and lower than a higher boundary frequency HF, wherein the lower boundary frequency LF and the higher boundary frequency HF are described below. The prohibited frequency band is set in advance based on a use frequency of the other electronic device, and is stored in advance in the ROM, the storage portion 27 or the like.

Figure 5:
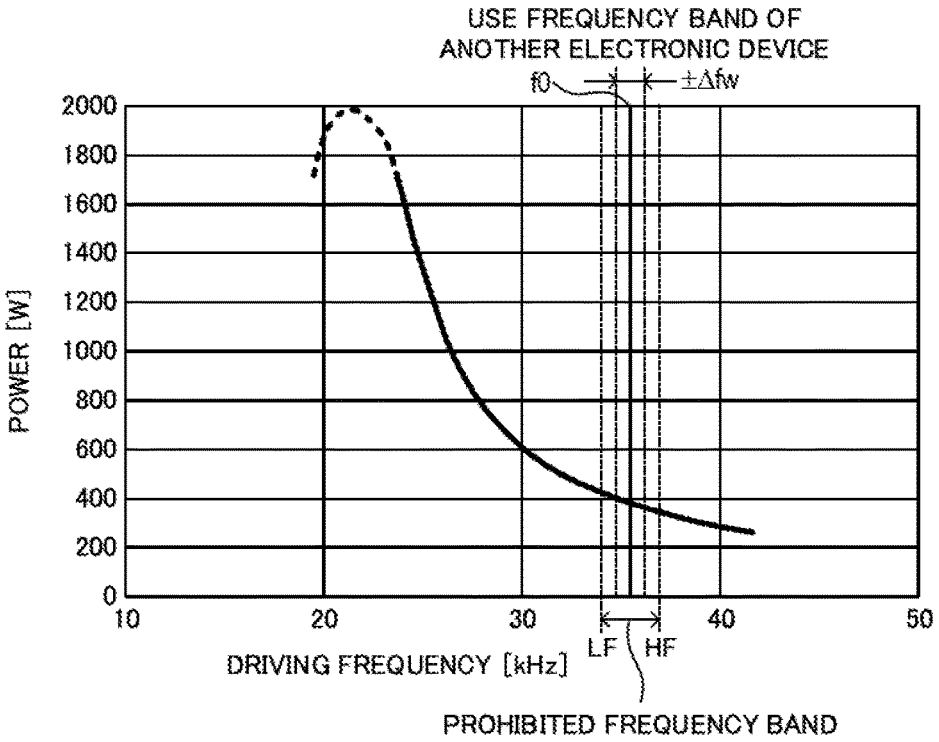
FIG. 5 is a diagram showing an example of a prohibited frequency band in the image forming apparatus according to the embodiment of the present disclosure.

The prohibited frequency band is set to completely cover the use frequency band of the other electronic device, as shown in FIG. 5, for example. For example, when the use frequency band of the other electronic device is $f0 \pm \Delta fw$, the prohibited frequency band is set to $f0 \pm 2\Delta fw$. It is noted that in this example, the bandwidth of the prohibited frequency band is set to two times the bandwidth of the use frequency band of the other electronic device, but this is only one example, and it may be set to an arbitrary magnification larger than one time. It is noted, however, that the bandwidth is preferably set to a magnification of two times or close to two times of the bandwidth of the use frequency band of the other electronic device, when it is taken into account that the malfunction of the other electronic device should be reliably prevented and that the bandwidth of the prohibited frequency band should be as small as possible.

It is noted that the other electronic device may malfunction due to not only the base wave but also the harmonic wave (a second harmonic wave, a third harmonic wave) of the driving frequency. Accordingly, to prevent the other electronic device from malfunctioning due to the second harmonic wave of the driving frequency, the prohibited frequency band is set to $\frac{1}{2} \times f0 \pm 2\Delta fw$, for example. In addition, to prevent the other electronic device from malfunctioning due to the third harmonic wave of the driving frequency, the prohibited frequency band is set to $\frac{1}{3} \times f0 \pm 2\Delta fw$, for example.

In the following description, a lower boundary frequency of the prohibited frequency band is referred to as a "lower boundary frequency LF" (see FIG. 5), and a higher boundary frequency of the prohibited frequency band is referred to as a "higher boundary frequency HF".

When the driving frequency determined by the frequency determining portion 41 (hereinafter referred to as a pre-change driving frequency) is within the prohibited frequency band and is lower than a predetermined threshold within the prohibited frequency band, the frequency changing portion 43 changes the pre-change driving frequency to a frequency equal to or lower than the lower boundary frequency LF (preferably to the lower boundary frequency LF). In addition, when the pre-change driving frequency is within the prohibited frequency band and is equal to or higher than the threshold, the frequency changing portion 43 changes the pre-change driving frequency to a frequency equal to or higher than the higher boundary frequency HF (preferably to the higher boundary frequency HF). In the following description, the driving frequency after the change by the frequency changing portion 43 is referred to as a "post-change driving frequency".

Figure 6:
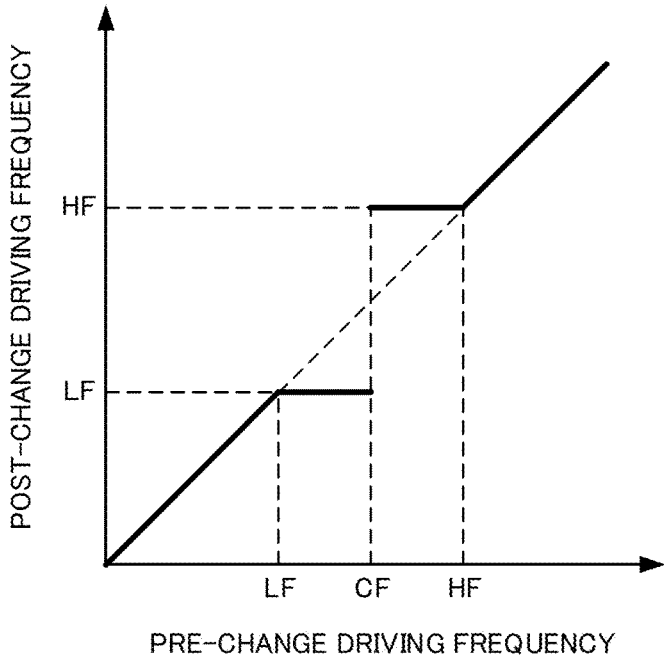
FIG. 6 is a diagram showing an example of a method to change the driving frequency in the image forming apparatus according to the embodiment of the present disclosure.

In the present embodiment, a center frequency of the prohibited frequency band, namely, a central frequency CF that is an average value of the lower boundary frequency LF and the higher boundary frequency HF, is adopted as the threshold. Thus, as shown in FIG. 6, when the pre-change driving frequency is equal to or higher than the lower boundary frequency LF and lower than the central frequency CF, the post-change driving frequency becomes the lower boundary frequency LF. On the other hand, when the pre-change driving frequency is equal to or higher than the central frequency CF and lower than the higher boundary frequency HF, the post-change driving frequency becomes the higher boundary frequency HF.

The heating control portion 44 drives the induction heater 33 by the post-change driving frequency. Specifically, the heating control portion 44 generates a drive signal corresponding to the post-change driving frequency and controls the switching elements Q1 and Q2 based on the generated drive signal. With this configuration, a high-frequency current corresponding to the post-change driving frequency is applied to the induction coil 34.

Figure 7:
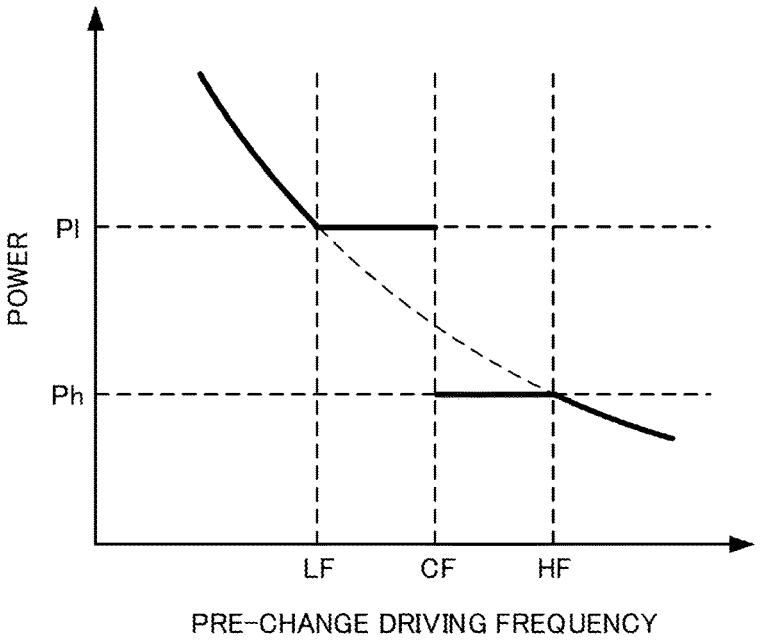
FIG. 7 is a diagram showing an example of relationship between power and the driving frequency of the induction heater included in the image forming apparatus according to the embodiment of the present disclosure.

In a case where the driving frequency is changed as described above, when the pre-change driving frequency is equal to or higher than the lower boundary frequency LF and lower than the central frequency CF, the power consumed by the induction coil 34 becomes a power P1 corresponding to the lower boundary frequency LF (see FIG. 7). On the other hand, when the pre-change driving frequency is equal to or higher than the central frequency CF and lower than the higher boundary frequency HF, the power consumed by the induction coil 34 becomes a power Ph corresponding to the higher boundary frequency HF (see FIG. 7).

As a result, when the pre-change driving frequency is equal to or higher than the lower boundary frequency LF and lower than the central frequency CF, the power consumed by the induction coil 34 may be larger than the target power. In addition, when the pre-change driving frequency is equal to or higher than the central frequency CF and lower than the higher boundary frequency HF, the power consumed by the induction coil 34 may be smaller than the target power. However, in the present embodiment, when the pre-change driving frequency is within the prohibited frequency band, the pre-change driving frequency is changed so that the post-change driving frequency is either the lower boundary frequency LF or the higher boundary frequency HF, by using the central frequency CF as the threshold, the central frequency CF being the center frequency of the prohibited frequency band. With this configuration, an average power of a macro-period in the order of several seconds becomes substantially the same as an average power of a case where the prohibited frequency band is not set. As a result, according to the present embodiment, it is possible to prevent a hot offset or a fixing defect that may occur when the prohibited frequency band is set.

It is noted that the prohibited frequency band may not necessarily be stored in the ROM, the storage portion 27 or the like in advance. The prohibited frequency setting portion 45 may set the prohibited frequency band based on an input operation performed on the operation/display portion 26.

Figure 8:
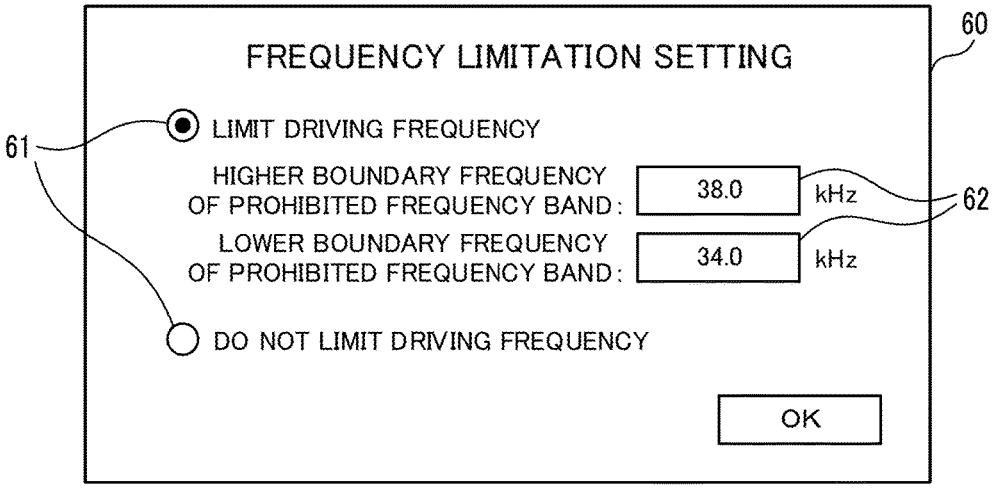
FIG. 8 is a diagram showing an example of a frequency limitation setting screen used in the image forming apparatus according to the embodiment of the present disclosure.

For example, when a predetermined operation is performed on the operation/display portion 26, the prohibited frequency setting portion 45 may display a frequency limitation setting screen 60 on the operation/display portion 26, as shown in FIG. 8. The frequency limitation setting screen 60 includes, for example, radio buttons 61 and input fields 62, wherein the radio buttons 61 are used to select whether or not to limit the driving frequency, and the input fields 62 are used to input the higher boundary frequency HF and the lower boundary frequency LF. In addition, the prohibited frequency setting portion 45 may set the prohibited frequency band based on the numerals input to the input field 62, and set and record the prohibited frequency band to the storage portion 27.

Figure 9:
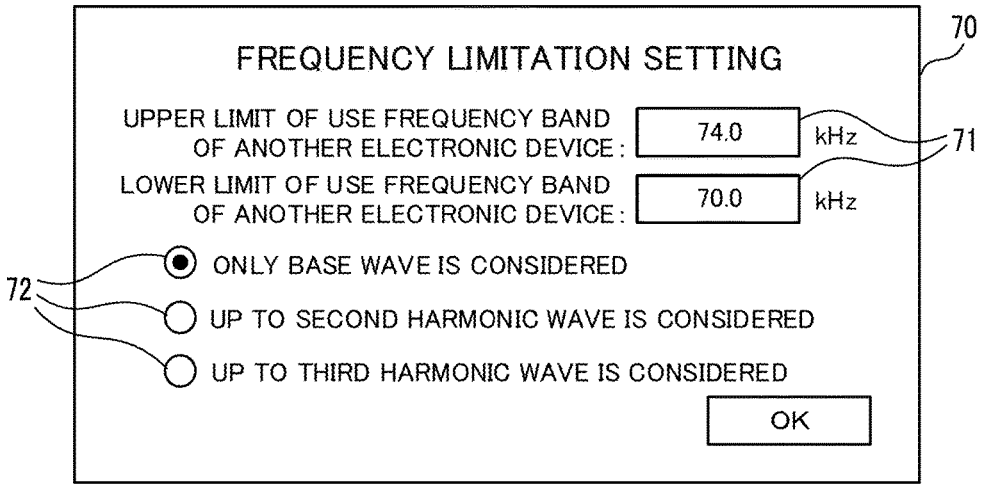
FIG. 9 is a diagram showing another example of the frequency limitation setting screen used in the image forming apparatus according to the embodiment of the present disclosure.

In addition, the prohibited frequency setting portion 45 may automatically calculate, and set, the prohibited frequency band from the use frequency band of the other electronic device that is input by an input operation performed on the operation/display portion 26. In this case, when a predetermined operation is performed on the operation/display portion 26, the prohibited frequency setting portion 45 may display a frequency limitation setting screen 70 on the operation/display portion 26, as shown in FIG. 9. The frequency limitation setting screen 70 includes, for example, input fields 71 and radio buttons 72, wherein the input fields 71 are used to input an upper limit and a lower limit of the use frequency band of the other electronic device, and the radio buttons 72 are used to select a range of the driving frequency which is considered when the prohibited frequency band is set, from among the base wave to up to the third harmonic wave. Here, the prohibited frequency setting portion 45 may automatically calculate the prohibited frequency band based on the numerals input to the input fields 71 and the selected radio button 72, and set and record the prohibited frequency band to the storage portion 27. For example, when the upper limit and lower limit of the use frequency band of the other electronic device are respectively fh0 and fl0, and the prohibited frequency band is to be set by considering up to the second harmonic wave, the prohibited frequency setting portion 45 set frequency bands of $f0 \pm 2\Delta fw$ and $\frac{1}{2} \times f0 \pm 2\Delta fw$ as the prohibited frequency bands, wherein $f0=(fh0+fl0)/2$, and $\Delta fw=(fh0-fl0)/2$. In addition, for example, when the upper limit and lower limit of the use frequency band of the other electronic device are respectively fh0 and fl0, and the prohibited frequency band is to be set by considering up to the third harmonic wave, the prohibited frequency setting portion 45 set frequency bands of $f0 \pm 2\Delta fw$, $\frac{1}{2} \times f0 \pm 2\Delta fw$, and $\frac{1}{3} \times f0 \pm 2\Delta fw$ as the prohibited frequency bands. That is, when the prohibited frequency band is to be set by considering up to the $n^{th}$ harmonic wave (n is integer 2 or more), the prohibited frequency setting portion 45 set the prohibited frequency bands including a frequency band that is 1/n of the use frequency band of the other electronic device. In this way, the prohibited frequency bands are automatically calculated and set based on the use frequency band of the other electronic device. This makes it possible to reduce the trouble of setting the prohibited frequency band.

Figure 10:
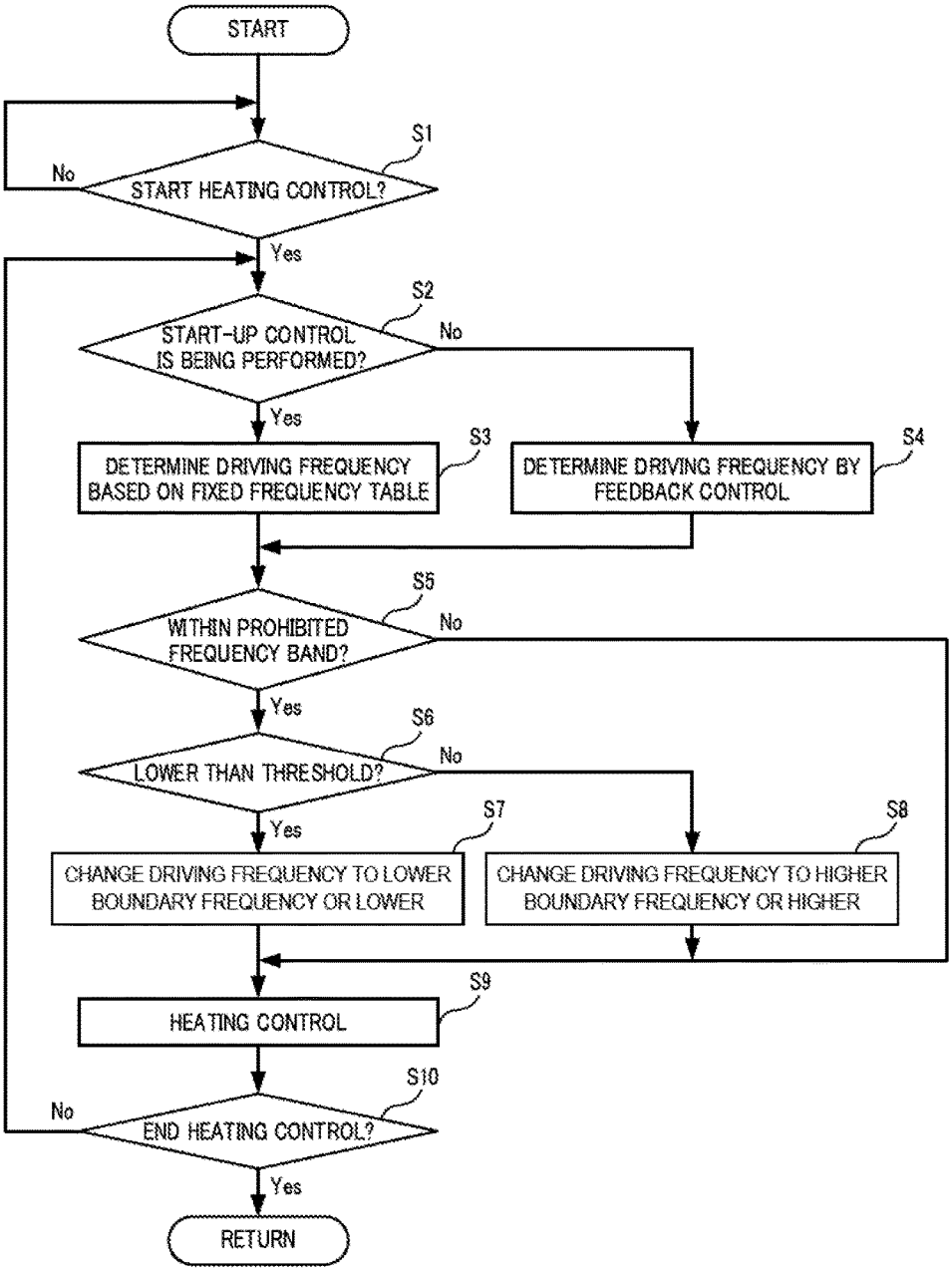
FIG. 10 is a flowchart showing an example of a heating control process executed by the image forming apparatus according to the embodiment of the present disclosure.

In the following, an example of the procedure of the heating control process executed by the control portion 25 is described with reference to FIG. 10. Here, steps S1, S2, . . . represent numbers assigned to the processing procedures (steps) executed by the control portion 25. It is noted that the heating control process is started when the image forming apparatus 1 is powered on, and is ended thereafter when the image forming apparatus 1 is powered off.

<Step S1>

First, in step S1, the control portion 25 determines whether or not to start the heating control. When the control portion 25 determines to start the heating control (S1: Yes), the process moves to step S2. On the other hand, when the control portion 25 determines not to start the heating control (S1: No), the control portion 25 repeats the process of step S1 until it is determined to start the heating control.

<Step S2>

In step S2, the control portion 25 determines whether or not the start-up control is being performed. When the control portion 25 determines that the start-up control is being performed (S2: Yes), the process moves to step S3. On the other hand, when the control portion 25 determines that the start-up control is not being performed (that is, the control has transitioned from the start-up control to the feedback control) (S2: No), the process moves to step S4.

<Step S3>

In step S3, the control portion 25 determines the driving frequency based on the fixed frequency table that is stored in the ROM, the storage portion 27 or the like in advance. Subsequently, the process moves to step S5.

<Step S4>

In step S4, the control portion 25 determines the driving frequency by the feedback control so that the power supplied to the induction coil 34 matches the target power. Subsequently, the process moves to step S5.

<Step S5>

In step S5, the control portion 25 determines whether or not the driving frequency determined in the step S3 or the step S4 is within the prohibited frequency band. When the control portion 25 determines that the driving frequency is within the prohibited frequency band (S5: Yes), the process moves to step S6. On the other hand, when the control portion 25 determines that the driving frequency is out of the prohibited frequency band (S5: No), the process moves to step S9.

<Step S6>

In step S6, the control portion 25 determines whether or not the driving frequency determined in the step S3 or the step S4 is lower than a predetermined threshold (the central frequency CF, for example). When the control portion 25 determines that the driving frequency is lower than the threshold (S6: Yes), the process moves to step S7. On the other hand, when the control portion 25 determines that the driving frequency is equal to or higher than the threshold (S6: No), the process moves to step S8.

<Step S7>

In step S7, the control portion 25 changes the driving frequency determined in the step S3 or the step S4, to the lower boundary frequency LF.

<Step S8>

In step S8, the control portion 25 changes the driving frequency determined in the step S3 or the step S4, to the higher boundary frequency HF.

<Step S9>

In step S9, in a case where it was determined as No in the step S5, the control portion 25 performs the heating control based on the driving frequency determined in the step S3 or the step S4; and in a case where it was determined as Yes in the step S5, the control portion 25 performs the heating control based on the driving frequency changed in the step S7 or the step S8.

<Step S10>

In step S10, the control portion 25 determines whether or not to end the heating control. When the control portion 25 determines to end the heating control (S10: Yes), the process returns to step S1. On the other hand, when the control portion 25 determines not to end the heating control (S10: No), the process returns to step S2.

It is noted that the processes of the steps S3 and S4 are executed by the frequency determining portion 41 of the control portion 25. The process of the step S5 is executed by the determination processing portion 42 of the control portion 25. The processes of the steps S7 and S8 are executed by the frequency changing portion 43 of the control portion 25. The process of the step S9 is executed by the heating control portion 44 of the control portion 25.

As described above, in the present embodiment, a frequency band that may cause a malfunction of another electronic device is set as a prohibited frequency band, and when a driving frequency determined by the feedback control or the like is within the prohibited frequency band, the driving frequency is changed to the lower boundary frequency LF or the higher boundary frequency HF with a threshold as a boundary. Thus, according to the present embodiment, a frequency band that may cause a malfunction of another electronic device is not used as the driving frequency. This makes it possible to prevent the malfunction of the other electronic device.

In addition, in the present embodiment, the driving frequency determined by the frequency determining portion 41 is changed by a common method shown in FIG. 6 regardless of whether the start-up control or the feedback control is being performed. As a result, it is possible to change the driving frequency without adding a change individually to a method by which the frequency determining portion 41 determines the driving frequency in the start-up control, and a method by which the frequency determining portion 41 determines the driving frequency in the feedback control.

Figure 11:
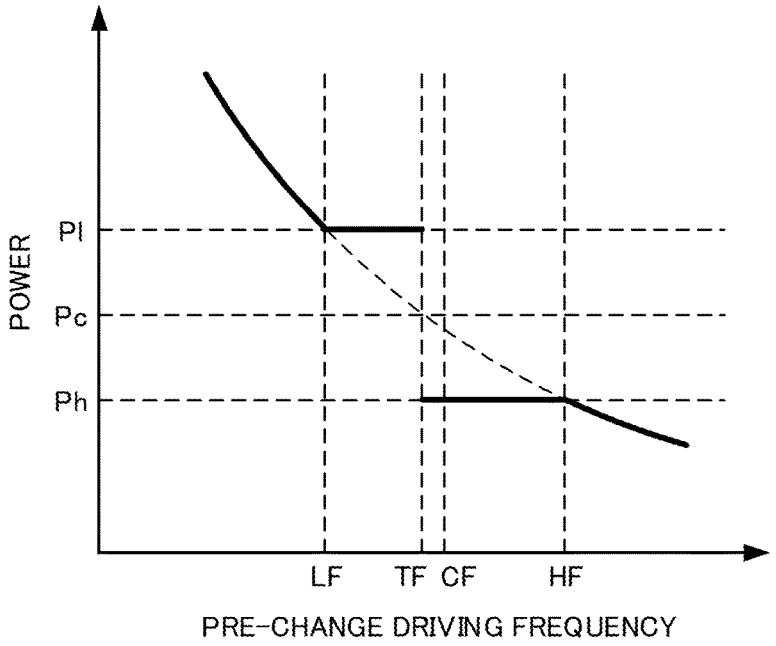
FIG. 11 is a diagram showing an example of relationship between power and the driving frequency of the induction heater included in the image forming apparatus according to the embodiment of the present disclosure.

It is noted that although in the present embodiment, the central frequency CF is adopted as the threshold, the present disclosure is not limited to this. For example, it may be taken into account that the graph showing relationship between the driving frequency and the power is curved in a downward convex shape as shown in FIG. 11, and a frequency lower than the central frequency CF may be adopted as the threshold. For example, in the case of the example shown in FIG. 11, Pc represents an average power between power P1 that corresponds to the lower boundary frequency LF, and power Ph that corresponds to the higher boundary frequency HF, TF represents a frequency equivalent to a driving frequency corresponding to the average power Pc and lower than the central frequency CF, and the frequency TF can be adopted as the threshold. This makes it possible to expect that an average power of a macro-period in the order of several seconds becomes close to an average power of a case where the prohibited frequency band is not set.

In another embodiment, the threshold may be set or changed based on an input operation performed on the operation/display portion 26. In a further embodiment, the threshold may be automatically changed in response to an operation state or the like of the image forming apparatus 1 or the fixing portion 23.

In the present embodiment, the belt portion of the fixing roller 31 is heated by the induction heating of the induction heater 33. The present disclosure, however, is not limited to this configuration, but is applicable to a configuration where an arbitrary heated member (for example, a fixing belt) included in the fixing portion 23 is heated by the induction heating of the induction heater 33.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a heated member;

an induction heater configured to heat the heated member by induction heating;

a frequency determining portion configured to determine a driving frequency of the induction heater;

a determination processing portion configured to determine whether or not the driving frequency determined by the frequency determining portion is within a predetermined prohibited frequency band;

a frequency changing portion configured to, when the driving frequency determined by the frequency determining portion is within the prohibited frequency band and is lower than a predetermined threshold within the prohibited frequency band, change the driving frequency to a frequency equal to or lower than a lower boundary frequency of the prohibited frequency band, and when the driving frequency is within the prohibited frequency band and is equal to or higher than the threshold, change the driving frequency to a frequency equal to or higher than a higher boundary frequency of the prohibited frequency band; and a heating control portion configured to drive the induction heater by the driving frequency changed by the frequency changing portion.

2. The fixing device according to claim 1, wherein the threshold is a center frequency of the prohibited frequency band.

3. The fixing device according to claim 1, wherein the frequency determining portion is configured to determine the driving frequency based on a fixed frequency table.

4. The fixing device according to claim 1, wherein the frequency determining portion is configured to determine the driving frequency by a feedback control.

5. The fixing device according to claim 1, further comprising:

a prohibited frequency setting portion configured to set the prohibited frequency band based on an input operation performed on an operation portion.

6. The fixing device according to claim 5, wherein the prohibited frequency setting portion configured to automatically calculate, and set, the prohibited frequency band from a use frequency band of another electronic device that is input by the input operation.

7. An image forming apparatus comprising:

an image generating portion configured to form a toner image on a sheet; and the fixing device according to claim 1 configured to fix the toner image to the sheet.

* * * * *